US010032401B2

(12) United States Patent
Wang et al.

(10) Patent No.: US 10,032,401 B2
(45) Date of Patent: Jul. 24, 2018

(54) PIXEL STRUCTURE, DISPLAY SUBSTRATE AND DISPLAY APPARATUS

(71) Applicants: Boe Technology Group Co., Ltd., Beijing (CN); Chengdu BOE Optoelectronics Technology Co., Ltd., Chengdu, Sichuan (CN)

(72) Inventors: Benlian Wang, Beijing (CN); Lei Dai, Beijing (CN)

(73) Assignees: BOE TECHNOLOGY GROUP CO., LTD., Beijing (CN); CHENGDU BOE OPTOELECTRONICS TECHNOLOGY CO., LTD., Beijing (CN)

( * ) Notice: Subject to any disclaimer, the term of this patent is extended or adjusted under 35 U.S.C. 154(b) by 106 days.

(21) Appl. No.: 14/777,728

(22) PCT Filed: Apr. 23, 2015

(86) PCT No.: PCT/CN2015/077289
§ 371 (c)(1),
(2) Date: Sep. 16, 2015

(87) PCT Pub. No.: WO2016/062049
PCT Pub. Date: Apr. 28, 2016

(65) Prior Publication Data

US 2016/0300521 A1 Oct. 13, 2016

(30) Foreign Application Priority Data

Oct. 20, 2014 (CN) ..... 2014 1 0559168

(51) Int. Cl.
*G09G 3/20* (2006.01)
*G09G 5/00* (2006.01)
(Continued)

(52) U.S. Cl.
CPC ..... *G09G 3/2003* (2013.01); *G09G 3/20* (2013.01); *G09G 3/3614* (2013.01);
(Continued)

(58) Field of Classification Search
CPC ..... G09G 2300/0452; G09G 3/2003; G09G 3/3607; G09G 2320/0666;
(Continued)

(56) References Cited

U.S. PATENT DOCUMENTS

2007/0268208 A1 11/2007 Okada et al.
2010/0097387 A1* 4/2010 Kim ..... G09G 3/2074 345/581
2012/0092237 A1* 4/2012 Phan ..... G09G 3/2003 345/55

FOREIGN PATENT DOCUMENTS

CN 103531099 A 1/2014
CN 103563368 A 2/2014
(Continued)

OTHER PUBLICATIONS

The International Search Report mailed Jul. 1, 2015 for International Application No. PCT/CN2015/077289.

*Primary Examiner* — Alexander Eisen
*Assistant Examiner* — Nan-Ying Yang
(74) *Attorney, Agent, or Firm* — Kinney & Lange, P.A.

(57) ABSTRACT

Embodiments of the present invention disclose a pixel structure, a display substrate and a display apparatus. The pixel structure includes a plurality of repeated units, each of the repeated units including a first portion, a second portion, a third portion, and a fourth portion which are arranged in a shape of a matrix of two rows by two columns. Each of the first through fourth portions includes four rows by four columns of sub-pixels, and includes, in each of the rows, the columns, and diagonals thereof, first through fourth sub-pixels which are different in color from one another. Two
(Continued)

| | | | |
|---|---|---|---|
| R+ | G- | B+ | W- |
| B- | W+ | R- | G+ |
| W+ | B- | G+ | R- |
| G- | R+ | W- | B+ |

(a)

| | | | |
|---|---|---|---|
| G+ | R- | W+ | B- |
| W- | B+ | G- | R+ |
| B+ | W- | R+ | G- |
| R- | G+ | B- | W+ |

(b)

| | | | |
|---|---|---|---|
| B+ | W- | R+ | G- |
| R- | G+ | B- | W+ |
| G+ | R- | W+ | B- |
| W- | B+ | G- | R+ |

(c)

| | | | |
|---|---|---|---|
| W+ | B- | G+ | R- |
| G- | R+ | W- | B+ |
| R+ | G- | B+ | W- |
| B- | W+ | R- | G+ |

(d)

sub-pixels, which have the same color, and are in the same row in any left-right adjacent two of the first through fourth portions, are in an odd-numbered column of one of the two portions and an even-numbered column of the other of the two portions, respectively; and two sub-pixels, which have the same color, and are in the same column in any up-down adjacent two of the first through fourth portions, are in an odd-numbered row of one of the two portions and an even-numbered row of the other of the two portions, respectively.

14 Claims, 2 Drawing Sheets

(51) Int. Cl.
*G09G 5/10* (2006.01)
*G09G 3/36* (2006.01)

(52) U.S. Cl.
CPC ..... *G09G 2300/0443* (2013.01); *G09G 2300/0452* (2013.01); *G09G 2320/0242* (2013.01); *G09G 2320/0247* (2013.01)

(58) Field of Classification Search
CPC ..... G09G 2300/0426; G09G 3/3648; G09G 3/2074; G09G 2300/0439
See application file for complete search history.

(56) References Cited

FOREIGN PATENT DOCUMENTS

| | | | |
|---|---|---|---|
| CN | 104299557 | A | 1/2015 |
| KR | 20090065110 | A | 6/2009 |
| KR | 20090073903 | A | 7/2009 |

* cited by examiner

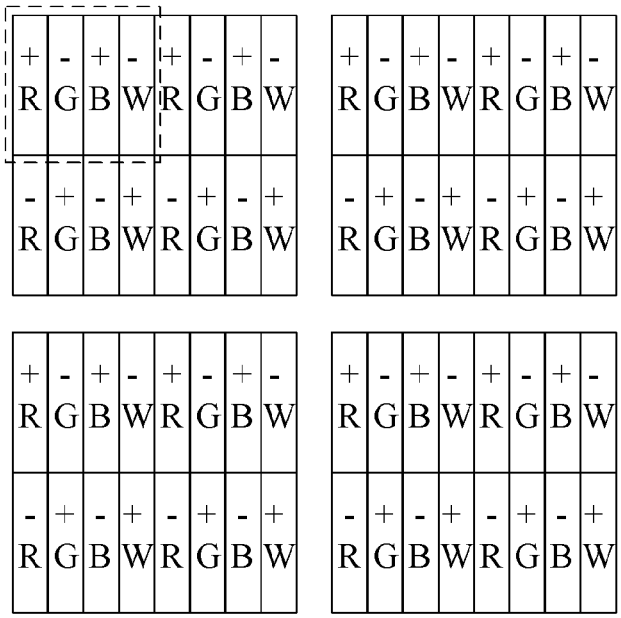
Figure 1 ( a ) Prior Art
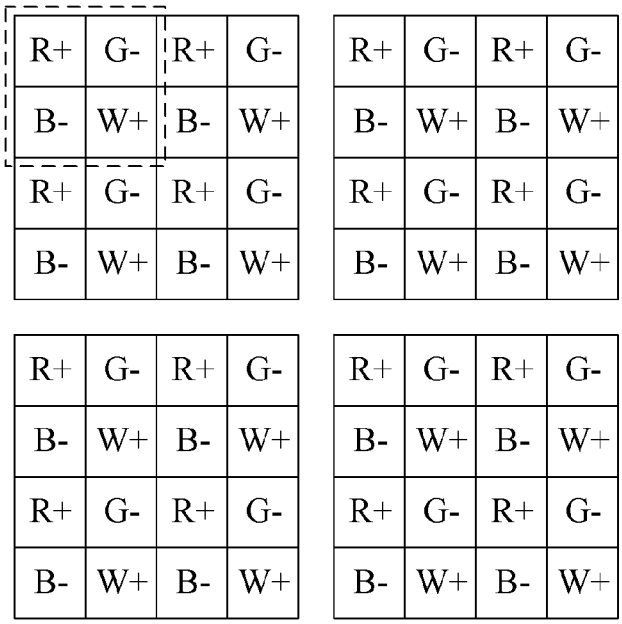
Figure 1 ( b ) Prior Art

| | | | |
|---|---|---|---|
| R+ | G- | B+ | W- |
| B- | W+ | R- | G+ |
| W+ | B- | G+ | R- |
| G- | R+ | W- | B+ |

(a)

| | | | |
|---|---|---|---|
| G+ | R- | W+ | B- |
| W- | B+ | G- | R+ |
| B+ | W- | R+ | G- |
| R- | G+ | B- | W+ |

(b)

| | | | |
|---|---|---|---|
| B+ | W- | R+ | G- |
| R- | G+ | B- | W+ |
| G+ | R- | W+ | B- |
| W- | B+ | G- | R+ |

(c)

| | | | |
|---|---|---|---|
| W+ | B- | G+ | R- |
| G- | R+ | W- | B+ |
| R+ | G- | B+ | W- |
| B- | W+ | R- | G+ |

(d)

PIXEL STRUCTURE, DISPLAY SUBSTRATE AND DISPLAY APPARATUS

BACKGROUND

1. Technical Field

The disclosure of the present invention relates to the field of display technology, and particularly to a pixel structure, a display substrate and a display apparatus.

2. Description of the Related Art

Generally, arrangement manners of R, G, B, and W sub-pixels in each pixel may be divided into a stripe-shaped arrangement manner indicated by broken lines in FIG. 1(*a*) and a checkerboard-shaped arrangement manner indicated by broken lines in FIG. 1(*b*).

SUMMARY

An object of embodiments of the present invent on is to provide a pixel structure, a display substrate and a display apparatus, by which, for example, horizontal stripes or phenomenon of picture flicker will not occur when a display apparatus is driven in a dot inversion driving manner, while improving color mixture uniformity of sub-pixels in a pixel structure such as a RGBW pixel structure.

Embodiments of the present invention provide a pixel structure comprising a plurality of repeating units, wherein: each of the repeating units comprises a first portion, a second portion, a third portion, and a fourth portion which are arranged in a shape of a matrix of two rows by two columns;

each of the first through fourth portions comprises four rows by four columns of sub-pixels, and comprises, in each of the rows, the columns, and diagonals thereof, one first sub-pixel, one second sub-pixel, one third sub-pixel, and one fourth sub-pixel which are different in color from one another;

two sub-pixels, which have the same color, and are in the same one of the four rows in any left-right adjacent two of the first through fourth portions, are in an odd-numbered column of one of the two portions and an even-numbered column of the other of the two portions, respectively; and two sub-pixels, which have the same color, and are in the same one of the four columns in any up-down adjacent two of the first through fourth portions, are in an odd-numbered row of one of the two portions and an even-numbered row of the other of the two portions, respectively.

According to embodiments of the present invention, sub-pixels in an odd-numbered column of one of the first through fourth portions are arranged in the same manner as sub-pixels in an even-numbered column of another, which is left-right adjacent to the one, of the first through fourth portions; and sub-pixels in an even-numbered column of the one of the first through fourth portions are arranged in the same manner as sub-pixels in an odd-numbered column of the another, which is left-right adjacent to the one, of the first through fourth portions.

According to embodiments of the present invention, sub-pixels in an odd-numbered row of one of the first through fourth portions are arranged in the same manner as sub-pixels in an even-numbered row of another, which is up-down adjacent to the one, of the first through fourth portions; and sub-pixels in an even-numbered row of the one of the first through fourth portions are arranged in the same manner as sub-pixels in an odd-numbered row of the another, which is up-down adjacent to the one, of the first through fourth portions.

According to embodiments of the present invention, sub-pixels in a first row of the first portion are arranged in an order of a first sub-pixel, a second sub-pixel, a third sub-pixel, and a fourth sub-pixel; sub-pixels in a second row of the first portion are arranged in an order of the third sub-pixel, the fourth sub-pixel, the first sub-pixel, and the second sub-pixel; sub-pixels in a third row of the first portion are arranged in an order of the fourth sub-pixel, the third sub-pixel, the second sub-pixel, and the first sub-pixel; and sub-pixels in a fourth row of the first portion are arranged in an order of the second sub-pixel, the first sub-pixel, the fourth sub-pixel, and the third sub-pixel;

the second portion is located on a right side of the first portion, and, sub-pixels in a first row of the second portion are arranged in an order of the second sub-pixel, the first sub-pixel, the fourth sub-pixel, and the third sub-pixel; sub-pixels in a second row of the second portion are arranged in an order of the fourth sub-pixel, the third sub-pixel, the second sub-pixel, and the first sub-pixel; sub-pixels in a third row of the second portion are arranged in an order of the third sub-pixel, the fourth sub-pixel, the first sub-pixel, and the second sub-pixel; and sub-pixels in a fourth row of the second portion are arranged in an order of the first sub-pixel, the second sub-pixel, the third sub-pixel, and the fourth sub-pixel;

the third portion is located under the first portion, and, sub-pixels in a first row of the third portion are arranged in an order of the third sub-pixel, the fourth sub-pixel, the first sub-pixel, and the second sub-pixel; sub-pixels in a second row of the third portion are arranged in an order of the first sub-pixel, the second sub-pixel, the third sub-pixel, and the fourth sub-pixel; sub-pixels in a third row of the third portion are arranged in an order of the second sub-pixel, the first sub-pixel, the fourth sub-pixel, and the third sub-pixel; and sub-pixels in a fourth row of the third portion are arranged in an order of the fourth sub-pixel, the third sub-pixel, the second sub-pixel, and the first sub-pixel; and the fourth portion is located under the second portion, and, sub-pixels in a first row of the fourth portion are arranged in an order of the fourth sub-pixel, the third sub-pixel, the second sub-pixel, and the first sub-pixel; sub-pixels in a second row of the fourth portion are arranged in an order of the second sub-pixel, the first sub-pixel, the fourth sub-pixel, and the third sub-pixel; sub-pixels in a third row of the fourth portion are arranged in an order of the first sub-pixel, the second sub-pixel, the third sub-pixel, and the fourth sub-pixel; and sub-pixels in a fourth row of the fourth portion are arranged in an order of the third sub-pixel, the fourth sub-pixel, the first sub-pixel, and the second sub-pixel.

According to embodiments of the present invention, all of the sub-pixels have the same area and are quadrangular in shape.

According to embodiments of the present invention, each sub-pixel is square in shape.

According to embodiments of the present invention, two sub-pixels, which have the same color, and are in the same one of the four rows in two, in the same row of the matrix, of the first through fourth portions, are in an odd-numbered column of one of the two portions and an even-numbered column of the other of the two portions, respectively; and two sub-pixels, which have the same color, and are in the same one of the four columns in two, in the same column of the matrix, of the first through fourth portions, are in an odd-numbered row of one of the two portions and an even-numbered row of the other of the two portions, respectively.

According to embodiments of the present invention, the first sub-pixel is a red sub-pixel R, the second sub-pixel is a green sub-pixel G, the third sub-pixel is a blue sub-pixel B, and the fourth sub-pixel is a white sub-pixel W.

According to embodiments of the present invention, the first sub-pixel is a red sub-pixel R, the second sub-pixel is a green sub-pixel G, the third sub-pixel is a blue sub-pixel B, and the fourth sub-pixel is a yellow sub-pixel Y.

According to embodiments of the present invention, sub-pixels in first and third columns of one of the first through fourth portions are arranged in the same manners as sub-pixels in second and fourth columns of another, which is left-right adjacent to the one, of the first through fourth portions, respectively; and sub-pixels in second and fourth columns of the one of the first through fourth portions are arranged in the same manners as sub-pixels in first and third columns of the another, which is left-right adjacent to the one, of the first through fourth portions, respectively.

According to embodiments of the present invention, sub-pixels in first and third rows of one of the first through fourth portions are arranged in the same manners as sub-pixels in second and fourth rows of another, which is up-down adjacent to the one, of the first through fourth portions, respectively; and sub-pixels in second and fourth rows of the one of the first through fourth portions are arranged in the same manners as sub-pixels in first and third rows of the another, which is up-down adjacent to the one, of the first through fourth portions, respectively.

In addition, embodiments of the present invention also provide a display substrate comprising the pixel structure of any one of the above embodiments.

Embodiments of the present invention also provide a display apparatus comprising the display substrate of the above embodiments.

According to embodiments of the present invention, driving polarities of any adjacent two of the sub-pixels are opposite to each other during displaying.

Embodiments of the present invention provide a display apparatus comprising the display substrate of the above embodiments.

BRIEF DESCRIPTION OF THE DRAWINGS

FIG. 1 is a schematic diagram showing a conventional arrangement manner of R, G, B, and W sub-pixels, and polarities of the R, G, B, and W sub-pixels occurring when a dot inversion driving manner is adopted, in which FIG. 1(*a*) is a schematic diagram showing a conventional stripe-shaped arrangement manner of the R, G, B, and W sub-pixels, and the polarities of the R, G, B, and W sub-pixels occurring when the dot inversion driving manner is adopted, and FIG. 1(*b*) is a schematic diagram showing a conventional checkerboard-shaped arrangement manner of the R, G, B, and W sub-pixels, and the polarities of the R, G, B, and W sub-pixels occurring when a dot inversion driving manner is adopted;

DETAILED DESCRIPTION OF THE EMBODIMENTS

Figures 2, 3:
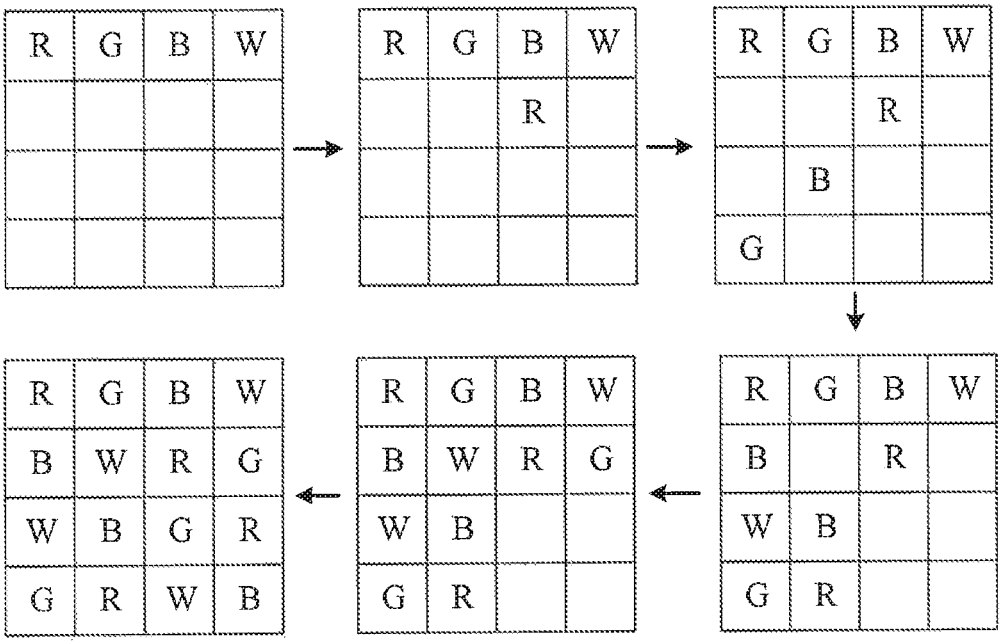
FIG. 2 is a schematic diagram of an arrangement process of R, G, B, and W sub-pixels in a first portion of a repeating unit in an embodiment of the present invention.
FIG. 3 is a schematic diagram showing an arrangement manner of R, G, B, and W sub-pixels in the repeating unit, and polarities of the R, G, B, and W sub-pixels occurring when a dot inversion driving manner is adopted, in an embodiment of the present invention, in which FIG. 3(*a*) is a schematic diagram showing an arrangement manner of the R, G, B, and W sub-pixels in the first portion of the repeating unit, and the polarities of the R, G, B, and W sub-pixels occurring when the dot inversion driving manner is adopted, FIG. 3(*b*) is a schematic diagram showing an arrangement manner of the R, G, B, and W sub-pixels in a second portion of the repeating unit, and the polarities of the R, G, B, and W sub-pixels occurring when the dot inversion driving is adopted, FIG. 3(*c*) is a schematic diagram showing an arrangement manner of the R, G, B, and W sub-pixels in a third portion of the repeating unit, and the polarities of the R, G, B, and W sub-pixels occurring when the dot inversion driving manner is adopted, and FIG. 3(*d*) is a schematic diagram showing an arrangement manner of the R, G, B, and W sub-pixels in a fourth portion of the repeating unit, and the polarities of the R, G, B, and W sub-pixels occurring when the dot inversion driving manner is adopted.

A further description of the invention will be made in detail as below with reference to embodiments of the present invention taken in conjunction with the accompanying drawings. The following embodiments are intended to explain the present invention and the present invention should not be construed as being limited to the embodiment set forth herein. In order to allow pictures displayed by the display apparatus to be clearer, a dot inversion driving manner is often adopted to drive the display apparatus. When the display apparatus is driven in the dot inversion driving manner, polarities of any adjacent two of sub-pixels are opposite to each other.

The inventors found that when R, G, B, W sub-pixels are arranged in the manner as shown in FIG. 1(*a*), two sub-pixels having the same color and located in two adjacent pixels in the same row have the same polarity (in FIG. 1(*a*), the polarities of the sub-pixels are indicated by "+" and "−"), and thus when the display apparatus entirely or partly displays one color, horizontal strips will occur in a picture so that the picture is unclear; and that when the R, G, B, W sub-pixels are arranged in the manner as shown in FIG. 1(*b*), two sub-pixels having the same color and located in any two adjacent pixels have the same polarity (in FIG. 1(*b*), the polarities of the sub-pixels are indicated by "+" and "−"), and thus when the display apparatus entirely or partly displays one color, phenomenon of flicker will occur in a picture.

Embodiments of the present invention provide a pixel structure, by which, horizontal stripes or a phenomenon of picture flicker will not occur when a display apparatus is driven in the dot inversion driving manner, while improving color mixture uniformity of sub-pixels in a RGBW pixel structure.

Embodiment 1

Embodiments of the present invention provide a pixel structure, by which, horizontal stripes or phenomenon of picture flicker will not occur when a display apparatus is driven in the dot inversion driving manner, while improving color mixture uniformity of sub-pixels in a RGBW pixel structure.

The pixel structure comprises a plurality of repeating units. Each of the repeating units comprises a first portion, a second portion, a third portion, and a fourth portion which are arranged in a 田 shape, or which are arranged in a shape of a matrix of two rows by two columns. For example, the second portion is located on a right side of the first portion, the third portion is located under the first portion, and the fourth portion is located under the second portion. Each of the first through fourth portions comprises four rows by four columns of sub-pixels, and comprises, in each of the rows, the columns, and diagonals thereof, one red sub-pixel R, one green sub-pixel G, one blue sub-pixel B, and one white sub-pixel W. Two sub-pixels, which have the same color, and are in the same one of the four rows in any left-right adjacent two of the first through fourth portions, are in an odd-numbered column of one of the two portions and an even-numbered column of the other of the two portions, respectively; and two sub-pixels, which have the same color, and are in the same one of the four columns in any up-down adjacent two of the first through fourth portions, are in an odd-numbered row of one of the two portions and an even-numbered row of the other of the two portions, respectively.

Specifically, in order to facilitate understanding of the embodiments by those skilled in the art, in the embodiments of the present invention, the first portion is taken as an example to expound how to ensure that the first portion comprises one red sub-pixel B, one green sub-pixel G one blue sub-pixel B, and one white sub-pixel W, in each of the rows, the columns, and the diagonals thereof.

For example, as shown in FIG. 2, when sub-pixels in a first row of the first portion are arranged in an order of the red sub-pixel R, the green sub-pixel G, the blue sub-pixel B, and the white sub-pixel W, in order to ensure that sub-pixels in each of a first column and a principal diagonal (running from the upper left corner to the lower right corner) of the first portion are different in color from one another, the red sub-pixel B in a second row can be only in a third column of the second row or a fourth column of the second row. In the embodiment of the present invention, the red sub-pixel B in the second row is in the third column. Furthermore, in order to ensure that sub-pixels in each of a second column and a minor diagonal (running from the lower left corner to the upper right corner) of the first portion are different in color from one another, the green sub-pixel G in the minor diagonal can be only in first column of a fourth row, and the blue sub-pixel B in the minor diagonal can be only in a second column of a third row. Similarly, it is determined in sequence that the blue sub-pixel B in the first column is in the second row, the white sub-pixel W in the first column is in the third row, the white sub-pixel W in the second row is in the second column, the green sub-pixel G in the second row is in the fourth column, the green sub-pixel G in the third row is in the third column, the red sub-pixel R in the third row is in the fourth column, the white sub-pixel W in the fourth row is in the third column, and the blue sub-pixel B in the fourth row is in the fourth column. Likewise, it can be known that when the red sub-pixel R in the second row is in the fourth column of the second row, the sub-pixels in the second now are arranged in an order of the white sub-pixel W, the blue sub-pixel B, the green sub-pixel G, and the red sub-pixel R, the sub-pixels in the third row are arranged in an order of the green sub-pixel G, the red sub-pixel B, the white sub-pixel W, and the blue sub-pixel B, and the sub-pixels in the fourth row are arranged in an order of the blue sub-pixel B, the white sub-pixel W, the red sub-pixel R, and the green sub-pixel G.

In addition to the two arrangement manners as described above, the sub-pixels in the first portion may also be arranged in various other manners so long as it is ensured that the first portion comprises, in each of the rows, the columns, and diagonals thereof, one red sub-pixel R, one green sub-pixel G, one blue sub-pixel B, and one white sub-pixel W. Here, it is no longer to list other arrangement manners one by one.

With similar arrangement manners, it can be ensured that sub-pixels in the second through fourth portions are arranged to satisfy a requirement that each of the second through fourth portions comprises, in each of the rows, the columns, and diagonals thereof, one red sub-pixel R, one green sub-pixel G, one blue sub-pixel B, and one white sub-pixel W.

In order to facilitate understanding of the embodiments by those skilled in the art, in the embodiments of the present invention, a specific embodiment is provided to ensure that two sub-pixels, which have the same color, and are in the same row in any left-right adjacent two of the first through fourth portions, are in an odd-numbered column of one of the two portions and an even-numbered column of the other of the two portions, respectively.

Specifically, in this embodiment, sub-pixels in an odd-numbered column of one of the first through fourth portions are arranged in the same manner as sub-pixels in an even-numbered column of another, which is left-right adjacent to the one, of the first through fourth portions; and sub-pixels in an even-numbered column of the one of the first through fourth portions are arranged in the same manner as sub-pixels in an odd-numbered column of the another, which is left-right adjacent to the one, of the first through fourth portions. For example, sub-pixels in first and third columns of one of the first through fourth portions are arranged in the same manners as sub-pixels in second and fourth columns of another, which is left-right adjacent to the one, of the first through fourth portions, respectively; and sub-pixels in second and fourth columns of the one of the first through fourth portions are arranged in the same manners as sub-pixels in first and third columns of the another, which is left-right adjacent to the one, of the first through fourth portions, respectively. For example, in the embodiment of the present invention, the second portion is located on a right side of the first portion, the sub-pixels in the first portion are arranged in a manner as shown in FIG. 3(*a*), the sub-pixels in the first column of the first portion are arranged in an order of the red sub-pixel R, the blue sub-pixel B, the white sub-pixel W, and the green sub-pixel G, the sub-pixels in the second column of the first portion are arranged in an order of the green sub-pixel the white sub-pixel W, the blue sub-pixel B, and the red sub-pixel R, the sub-pixels in the third column of the first portion are arranged in an order of the blue sub-pixel B, the red sub-pixel R the green sub-pixel and the white sub-pixel W, and the sub-pixels in the fourth column of the first portion are arranged in an order of the white sub-pixel W, the green sub-pixel G, the red sub-pixel R, and the blue sub-pixel B; and it can be determined from the above embodiments that the sub-pixels in the second portion are arranged in a manner as shown in FIG. 3(*b*), the sub-pixels in the first column of the second portion are arranged in an order of the green sub-pixel G, the white sub-pixel W, the blue sub-pixel B, and the red sub-pixel R, the sub-pixels in the second column of the second portion are arranged in an order of the red sub-pixel R, the blue sub-pixel B, the white sub-pixel W, and the green sub-pixel G, the sub-pixels in the third column of the second portion are arranged in an order of the white sub-pixel W, the green sub-pixel G, the red sub-pixel R, and the blue sub-pixel B, and the sub-pixels in the fourth column of the second portion are arranged in an order of the blue sub-pixel B, the red sub-pixel R the green sub-pixel G, and the white sub-pixel W.

In addition, in order to facilitate understanding of the embodiments by those skilled in the art, in the embodiments of the present invention, another specific embodiment is also provided to ensure that two sub-pixels, which have the same color, and are in the same column in any up-down adjacent two of the first through fourth portions, are in an odd-numbered row of one of the two portions and an even-numbered row of the other of the two portions, respectively.

Specifically, in this embodiment, sub-pixels in an odd-numbered row of one of the first through fourth portions are arranged in the same manner as sub-pixels in an even-numbered row of another, which is up-down adjacent to the one, of the first through fourth portions; and sub-pixels in an even-numbered row of the one of the first through fourth portions are arranged in the same manner as sub-pixels in an odd-numbered row of the another, which is up-down adjacent to the one, of the first through fourth portions. For example, sub-pixels in first and third rows of one of the first through fourth portions are arranged in the same manners as sub-pixels in second and fourth rows of another, which is up-down adjacent to the one, of the first through fourth portions, respectively; and sub-pixels in second and fourth rows of the one of the first through fourth portions are arranged in the same manners as sub-pixels first and third rows of the another, which is up-down adjacent to the one, of the first through fourth portions, respectively.

For example, in an embodiment of the present invention, the third portion is located under the first portion, the sub-pixels in the first portion are arranged in a manner as shown in FIG. 3(*a*), the sub-pixels in the first row of the first portion are arranged in an order of the red sub-pixel R, the green sub-pixel G, the blue sub-pixel B, and the white sub-pixel W, the sub-pixels in the second row of the first portion are arranged in an order of the blue sub-pixel B, the white sub-pixel W, the red sub-pixel R, and the green sub-pixel G, the sub-pixels in the third row of the first portion are arranged in an order of the white sub-pixel W, the blue sub-pixel B, the green sub-pixel G, and the red sub-pixel R, and the sub-pixels in the fourth row of the first portion are arranged in an order of the green sub-pixel G, the red sub-pixel R, the white sub-pixel W, and the blue sub-pixel B; and it can be determined from the above embodiments that the sub-pixels in the third portion are arranged in a manner as shown in FIG. 3(*c*), the sub-pixels in the first row of the third portion are arranged in an order of the blue sub-pixel B, the white sub-pixel W, the red sub-pixel R, and the green sub-pixel G, the sub-pixels in the second row of the third portion are arranged in an order of the red sub-pixel R, the green sub-pixel G, the blue sub-pixel B, and the white sub-pixel W, the sub-pixels in the third row of the third portion are arranged in an order of the green sub-pixel G, the red sub-pixel R, the white sub-pixel W, and the blue sub-pixel B; and the sub-pixels in the fourth row of the third portion are arranged in an order of the white sub-pixel W, the blue sub-pixel B, the green sub-pixel G, and the red sub-pixel R.

Furthermore, after the arrangement manners of the sub-pixels of the first portion and the second portion are determined, an arrangement manner of the sub-pixels in the fourth portion, which is located under the second portion as shown in FIG. 3(*d*), can be determined in the following manner according to the arrangement manner of the sub-pixels in the second portion: two sub-pixels, which have the same color, and are in the same column in any up-down adjacent two of the first through fourth portions, are in an odd-numbered row of one of the two portions and an even-numbered row of the other of the two portions, respectively. Alternatively, after the arrangement manners of the sub-pixels of the first portion and the third portion are determined, an arrangement manner of the sub-pixels in the fourth portion can also be determined in the following manner according to the arrangement manner of the sub-pixels of the third portion: two sub-pixels, which have the same color, and are in the same column in any up-down adjacent two of the first through fourth portions, are in an odd-numbered row of one of the two portions and an even-numbered row of the other of the two portions, respectively.

From the above arrangement manner of the sub-pixels in the first portion, the second portion, the third portion, and the fourth portion of the repeating unit, it can be known that when the arrangement manner of the sub-pixels of the first portion of the repeating unit is determined, the arrangement manner of the sub-pixels of the repeating unit is also determined correspondingly. Therefore, when there are many arrangement manners of the sub-pixels of the first portion of the repeating unit, there are also many arrangement manners of the sub-pixels of the repeating unit correspondingly. Only one arrangement manner of the sub-pixels of the repeating unit has been described in the above embodiment. Other arrangement manners of the sub-pixels of the repeating unit are no longer described for the sake of brevity.

Furthermore, as shown in FIG. 3, embodiments of the present invention provide a specific arrangement manner of the sub-pixels of the repeating unit as follows: the sub-pixels in the first row of the first portion are arranged in an order of the red sub-pixel R, the green sub-pixel the blue sub-pixel B, and the white sub-pixel W, the sub-pixels in the second row of the first portion are arranged in an order of the blue sub-pixel B, the white sub-pixel W, the red sub-pixel R, and the green sub-pixel the sub-pixels in the third row of the first portion are arranged in an order of the white sub-pixel W, the blue sub-pixel B, the green sub-pixel G, and the red sub-pixel R, and the sub-pixels in the fourth row of the first portion are arranged in an order of the green sub-pixel G, the red sub-pixel R, the white sub-pixel W, and the blue sub-pixel B, the second portion is located on a right side of the first portion, the sub-pixels in the first row of the second portion are arranged in an order of the green sub-pixel G, the red sub-pixel R, the white sub-pixel W, and the blue sub-pixel B; the sub-pixels in the second row of the second portion are arranged in an order of the white sub-pixel W, the blue sub-pixel B, the green sub-pixel G, and the red sub-pixel R, the sub-pixels in the third row of the second portion are arranged in an order of the blue sub-pixel B, the white sub-pixel W, the red sub-pixel R, and the green sub-pixel G, and the sub-pixels in the fourth row of the second portion are arranged in an order of the red sub-pixel R, the green sub-pixel G, the blue sub-pixel B, and the white sub-pixel W; the third portion is located under the first portion, the sub-pixels in the first row of the third portion are arranged in an order of the blue sub-pixel B, the white sub-pixel W, the red sub-pixel R, and the green sub-pixel G, the sub-pixels in the second row of the third portion are arranged in an order of the red sub-pixel B, the green sub-pixel the blue sub-pixel B, and the white sub-pixel W, the sub-pixels in the third row of the third portion are arranged in an order of the green sub-pixel G, the red sub-pixel R, the white sub-pixel W, and the blue sub-pixel B, and the sub-pixels in the fourth row of the third portion are arranged in an order of the white sub-pixel W, the blue sub-pixel B, the green sub-pixel G; and the red sub-pixel B; and the fourth portion is located under the second portion, the sub-pixels in the first row of the fourth portion are arranged in an order of the white sub-pixel W, the blue sub-pixel B, the green sub-pixel G, and the red sub-pixel R, the sub-pixels in the second row of the fourth portion are arranged in an order of the green sub-pixel G, the red sub-pixel R, the white sub-pixel W and the blue sub-pixel B, the sub-pixels in the third row of the fourth portion are arranged in an order of the red sub-pixel R, the green sub-pixel the blue sub-pixel B, and the white sub-pixel W, and the sub-pixels in the fourth row of the fourth portion are arranged in an order of the blue sub-pixel B, the white sub-pixel W the red sub-pixel R, and the green sub-pixel G.

In some embodiments, all of the sub-pixels have the same area and are quadrangular in shape. For example, each sub-pixel is square in shape.

Embodiments of the present invention provide a pixel structure comprising a plurality of repeating units. Firstly, each of the repeating units comprises a first portion, a second portion, a third portion, and a fourth portion which are arranged in a shape of a matrix of two rows by two column; Secondly, each of the first through fourth portions comprises four rows by four columns of sub-pixels, and comprises, in each of the rows, the columns, and diagonals thereof, one red sub-pixel R, one green sub-pixel G, one blue sub-pixel B, and one white sub-pixel W; and Thirdly, two sub-pixels, which have the same color, and are in the same row in any left-right adjacent two of the first through fourth portions, are in an odd-numbered column of one of the two portions and an even-numbered column of the other of the two portions, respectively, and two sub-pixels, which have the same color, and are in the same column in any up-down adjacent two of the first through fourth portions, are in an odd-numbered row of one of the two portions and an even-numbered row of the other of the two portions, respectively. When the display apparatus is driven in the dot inversion driving manner. Since the sub-pixels in the pixel structure according to the embodiments of the present invention are arranged in the manner as described, color mixture uniformity of sub-pixels in a RGBW pixel structure is improved, and at the same time driving polarities of two sub-pixels having the same color and located in two adjacent pixels in the same row are opposite to each other and driving polarities of two sub-pixels having the same color and located in two adjacent pixels in the same column are opposite to each other. Therefore, when the display apparatus entirely or partly displays one color, horizontal and vertical stripes or phenomenon of picture flicker will not occur.

In addition, embodiments of the present invention also provide a display substrate comprising the pixel structure of any one of the above embodiments.

Embodiment 2

Embodiments of the present invention also provide a display apparatus comprising the display substrate of the above embodiments. The display apparatus may comprise any products or parts having display function such as a liquid crystal panel, a tablet computer, a TV a display, a notebook computer, an electronic paper, a mobile phone, a digital frame, and navigator, etc. For example, when the display apparatus is driven in the dot inversion driving manner, driving polarities of any adjacent two of sub-pixels are opposite to each other during displaying of the display apparatus.

Embodiments of the present invention provide a display apparatus comprising the display substrate of the above embodiments. When the display apparatus is driven in the dot inversion driving manner, since sub-pixels in the pixel structure of the display substrate according to the embodiments of the present invention are arranged in the manner as those in the first embodiment, color mixture uniformity of sub-pixels in a RGBW pixel structure is improved, and at the same time polarities of two sub-pixels having the same color and located in two adjacent pixels in the same row are opposite to each other while polarities of two sub-pixels having the same color and located in two adjacent pixels in the same column are opposite to each other. Therefore, when the display apparatus entirely or partly displays one color, horizontal and vertical stripes and phenomenon of picture flicker will not occur in a displayed picture.

Although the present invention has been described by taking the RGBW pixel structure as an example, it is not limited to the above embodiments. For example, the concept of the present invention is also applicable to other pixel structure such as a RGBY pixel structure.

The above embodiments are only used to explain the present invention, and should not be construed to limit the present invention. It will be understood by those skilled in the art that various changes and modifications may be made therein without departing from the spirit of the present invention, the scope of which is defined in the appended claims and their equivalents.

What is claimed is:

1. A pixel structure comprising a plurality of repeating units, wherein:

each of the repeating units comprises a first portion, a second portion, a third portion, and a fourth portion which are arranged in a shape of a matrix of two rows by two columns;

each of the first through fourth portions comprises four rows by four columns of sub-pixels, and comprises, in each of the rows, the columns, and diagonals thereof, one first sub-pixel, one second sub-pixel, one third sub-pixel, and one fourth sub-pixel which are different in color from one another; and two sub-pixels, which have the same color, and are in the same one of the four rows in any left-right adjacent two of the first through fourth portions, are in an odd-numbered column of one of the two left-right adjacent portions and an even-numbered column of the other of the two left-right adjacent portions, respectively; and two sub-pixels, which have the same color, and are in the same one of the four columns in any up-down adjacent two of the first through fourth portions, are in an odd-numbered row of one of the two up-down adjacent portions and an even-numbered row of the other of the two up-down adjacent portions, respectively.

2. The pixel structure of claim 1, wherein:

sub-pixels in an odd-numbered column of one of the first through fourth portions are arranged in the same manner as sub-pixels in an even-numbered column of another, which is left-right adjacent to the one, of the first through fourth portions; and sub-pixels in an even-numbered column of the one of the first through fourth portions are arranged in the same manner as sub-pixels in an odd-numbered column of the another, which is left-right adjacent to the one, of the first through fourth portions.

3. The pixel structure of claim 1, wherein:

sub-pixels in an odd-numbered row of one of the first through fourth portions are arranged in the same manner as sub-pixels in an even-numbered row of another, which is up-down adjacent to the one, of the first through fourth portions; and sub-pixels in an even-numbered row of the one of the first through fourth portions are arranged in the same manner as sub-pixels in an odd-numbered row of the another, which is up-down adjacent to the one, of the first through fourth portions.

4. The pixel structure of claim 1, wherein:

sub-pixels in a first row of the first portion are arranged in an order of a first sub-pixel, a second sub-pixel, a third sub-pixel, and a fourth sub-pixel; sub-pixels in a second row of the first portion are arranged in an order of the third sub-pixel, the fourth sub-pixel, the first sub-pixel, and the second sub-pixel; sub-pixels in a third row of the first portion are arranged in an order of the fourth sub-pixel, the third sub-pixel, the second sub-pixel, and the first sub-pixel; and sub-pixels in a fourth row of the first portion are arranged in an order of the second sub-pixel, the first sub-pixel, the fourth sub-pixel, and the third sub-pixel;

the second portion is located on a right side of the first portion, sub-pixels in a first row of the second portion are arranged in an order of the second sub-pixel, the first sub-pixel, the fourth sub-pixel, and the third sub-pixel; sub-pixels in a second row of the second portion are arranged in an order of the fourth sub-pixel, the third sub-pixel, the second sub-pixel, and the first sub-pixel; sub-pixels in a third row of the second portion are arranged in an order of the third sub-pixel, the fourth sub-pixel, the first sub-pixel, and the second sub-pixel; and sub-pixels in a fourth row of the second portion are arranged in an order of the first sub-pixel, the second sub-pixel, the third sub-pixel, and the fourth sub-pixel;

the third portion is located under the first portion, sub-pixels in a first row of the third portion are arranged in an order of the third sub-pixel, the fourth sub-pixel, the first sub-pixel, and the second sub-pixel; sub-pixels in a second row of the third portion are arranged in an order of the first sub-pixel, the second sub-pixel, the third sub-pixel, and the fourth sub-pixel; sub-pixels in a third row of the third portion are arranged in an order of the second sub-pixel, the first sub-pixel, the fourth sub-pixel, and the third sub-pixel; and sub-pixels in a fourth row of the third portion are arranged in an order of the fourth sub-pixel, the third sub-pixel, the second sub-pixel, and the first sub-pixel; and the fourth portion is located under the second portion, sub-pixels in a first row of the fourth portion are arranged in an order of the fourth sub-pixel, the third sub-pixel, the second sub-pixel, and the first sub-pixel; sub-pixels in a second row of the fourth portion are arranged in an order of the second sub-pixel, the first sub-pixel, the fourth sub-pixel, and the third sub-pixel; sub-pixels in a third row of the fourth portion are arranged in an order of the first sub-pixel, the second sub-pixel, the third sub-pixel, and the fourth sub-pixel; and sub-pixels in a fourth row of the fourth portion are arranged in an order of the third sub-pixel, the fourth sub-pixel, the first sub-pixel, and the second sub-pixel.

5. The pixel structure of claim 1, wherein: all of the sub-pixels have the same area and are quadrangular in shape.

6. The pixel structure of claim 5, wherein: each sub-pixel is square in shape.

7. The pixel structure of claim 1, wherein: two sub-pixels, which have the same color, and are in the same one of the four rows in two, in the same row of the matrix, of the first through fourth portions, are in an odd-numbered column of one of the two portions and an even-numbered column of the other of the two portions, respectively; and two sub-pixels, which have the same color, and are in the same one of the four columns in two, in the same column of the matrix, of the first through fourth portions, are in an odd-numbered row of one of the two portions and an even-numbered row of the other of the two portions, respectively.

8. The pixel structure of claim 1, wherein: the first sub-pixel is a red sub-pixel R, the second sub-pixel is a green sub-pixel G, the third sub-pixel is a blue sub-pixel B, and the fourth sub-pixel is a white sub-pixel W.

9. The pixel structure of claim 1, wherein: the first sub-pixel is a red sub-pixel R, the second sub-pixel is a green sub-pixel G, the third sub-pixel is a blue sub-pixel B, and the fourth sub-pixel is a yellow sub-pixel Y.

10. The pixel structure of claim 1, wherein:

sub-pixels in first and third columns of one of the first through fourth portions are arranged in the same manners as sub-pixels in second and fourth columns of another, which is left-right adjacent to the one, of the first through fourth portions, respectively; and sub-pixels in second and fourth columns of the one of the first through fourth portions are arranged in the same manners as sub-pixels in first and third columns of the another, which is left-right adjacent to the one, of the first through fourth portions, respectively.

11. The pixel structure of claim 1, wherein:

sub-pixels in first and third rows of one of the first through fourth portions are arranged in the same manners as sub-pixels in second and fourth rows of another, which is up-down adjacent to the one, of the first through fourth portions, respectively; and sub-pixels in second and fourth rows of the one of the first through fourth portions are arranged in the same manners as sub-pixels in first and third rows of the another, which is up-down adjacent to the one, of the first through fourth portions, respectively.

12. A display substrate comprising the pixel structure of claim 1.

13. A display apparatus comprising the display substrate of claim 12.

14. The display apparatus of claim 13, wherein: driving polarities of any adjacent two of the sub-pixels are opposite to each other during displaying.

* * * * *